US006655618B1

(12) United States Patent
Emmerich

(10) Patent No.: US 6,655,618 B1
(45) Date of Patent: Dec. 2, 2003

(54) INDICATOR OF THE PROPER DIRECTION OF EXIT OF PAPER AND OF OTHER MATERIALS IN ROLLS

(76) Inventor: Francisco Guilherme Emmerich, Rua Chapot Presvot 353, apto. 801 Praia do Canto, Vitoria Espirito Santo (BR), 29055-410

( * ) Notice: Subject to any disclaimer, the term of this patent is extended or adjusted under 35 U.S.C. 154(b) by 15 days.

(21) Appl. No.: 10/018,434

(22) PCT Filed: Jun. 21, 2000

(86) PCT No.: PCT/BR00/00072

§ 371 (c)(1),
(2), (4) Date: Apr. 9, 2002

(87) PCT Pub. No.: WO00/78196

PCT Pub. Date: Dec. 28, 2000

(30) Foreign Application Priority Data

Jun. 21, 1999 (BR) ..... 9902907

(51) Int. Cl.[7] ..... B65H 18/28

(52) U.S. Cl. ..... 242/160.1; 242/912; 206/398; 206/410

(58) Field of Search ..... 242/160.1, 912; 206/389, 398, 400, 408, 410

(56) References Cited

U.S. PATENT DOCUMENTS 1,806,273 A * 5/1931 Williams ..... 242/160.1

FOREIGN PATENT DOCUMENTS

FR 2 602 901 A 2/1988
JP 51-118 506 A 10/1976

* cited by examiner

*Primary Examiner*—John Q. Nguyen
(74) *Attorney, Agent, or Firm*—Nixon & Vanderhye PC

(57) ABSTRACT

It is presented here an invention which aims at providing a simple indicator of direction for the exit of paper and of other materials in rolls of the respective materials installed as rotate reels. The invention is characterised by presenting a column formed by two successive alternate groups of words/phrases and arrows in horizontal lines, informing basically if the direction is correct (1) or incorrect (2), written upside down in relation to each other. The group of words/phrases and arrows can be printed in the involucre of the roll, where many times there are specifications of the product, or can be affixed in the roll. The correct displacement direction and the incorrect displacement direction can be easily verified by the installer, because there is a natural tendency of people to read what it is written in the usual direction of writing and reading (with the letters with the head upward and from left to right (1 and 4)); and there is a natural difficulty of people to read what is written upside down and from the right to the left (2 and 3).

1 Claim, 3 Drawing Sheets

INDICATOR OF THE PROPER DIRECTION OF EXIT OF PAPER AND OF OTHER MATERIALS IN ROLLS

This application is the U.S. national phase of international application PCT/BR00/00072 filed Jun. 21, 2000, which designated the U.S.

The technical field that relates to the present invention is that of wrapping of rolls of paper and of other materials installed as rotate reels.

This invention aims at providing an indicator of the proper direction for the exit of paper and of other materials in rolls of the respective materials installed as rotate reels.

Figure 1A:
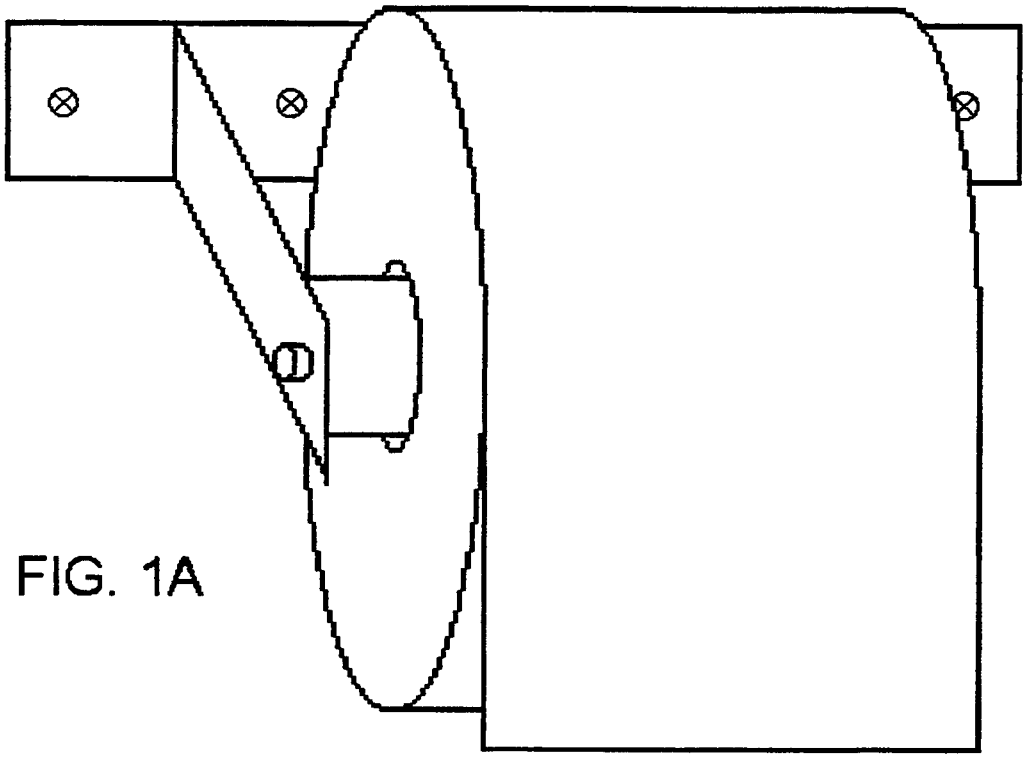
Figure 1B:
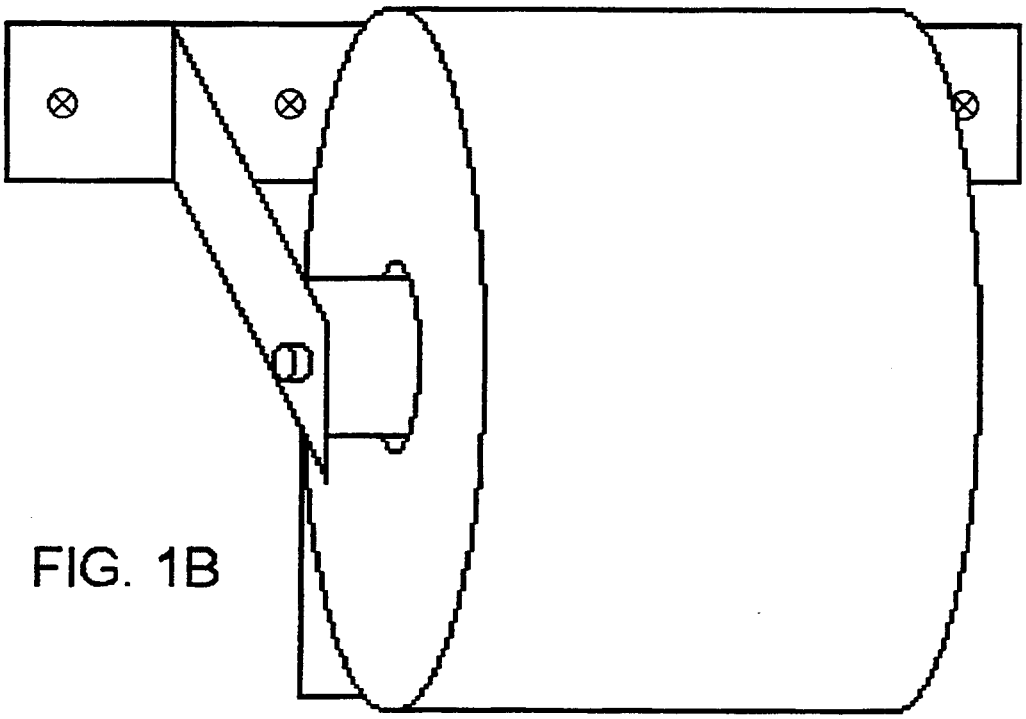

The rolls of paper, woven and other materials, such as rolls of hygienic paper, of paper towel and of aluminium paper, installed as rotate reels, can be placed in the rotating device so that the direction for the exit of the material occurs from the front of the roll or from behind the roll, as it is shown in FIG. 1A and FIG. 1B respectively.

Great advantages usually exist if the exit of the material in the roll occurs from the front (FIG. 1A). The main advantage is characterised by the easiness to visualise and to catch the extremity of the material from the front, which does not happen when the material leaves the roll from behind (FIG. 1B), because the extremity of the material can be hidden, that is, eclipsed by the roll and the person usually needs to rotate the roll or to look for another way to find the extremity of the material. In the cases where the roll of the material is conditioned in re-entrant devices, what is frequently used in the case of rolls of hygienic paper, a second advantage in having the material leaving from the front is concerned with hygiene, because both the external surface of the material and its extremity do not stay in contact with the surface of the re-entrant device, which may not be perfectly clean. Therefore, it is usually more hygienic to use the material leaving from the front, because in the other case the external surface of the material and its extremity frequently can be in contact with the surface of the re-entrant device. Consequently, for a wide category of cases, it is possible to consider that the more appropriated way of setting the rolls is that of FIG. 1A.

When the roll is initially placed in the rotating device, for the person to be certain of the proper direction of exit of the material, he or she should try to verify where is the extremity of the material and its exit direction in the external surface of the roll. In several cases, this verification may demand the undesirable initial retreat of some material from the roll because the extremity of the material can be glued or conditioned in such a way that this premature initial retrieving of material has to be done. Even if the extremity of the material and its exit direction in the external surface of the roll can be observed without problems, many installers, due to the lack of attention or other reasons, may not place the roll in the direction more appropriated for the use of the material. The invention here proposed presents a simple solution to indicate the more appropriated direction of exit of the material from the roll. Not only the user will benefit from the invention, but also the manufacturer of the roll, because with the indication of the most correct direction of exit of the material of the roll it may attract more consumers for its product.

Figure 2:
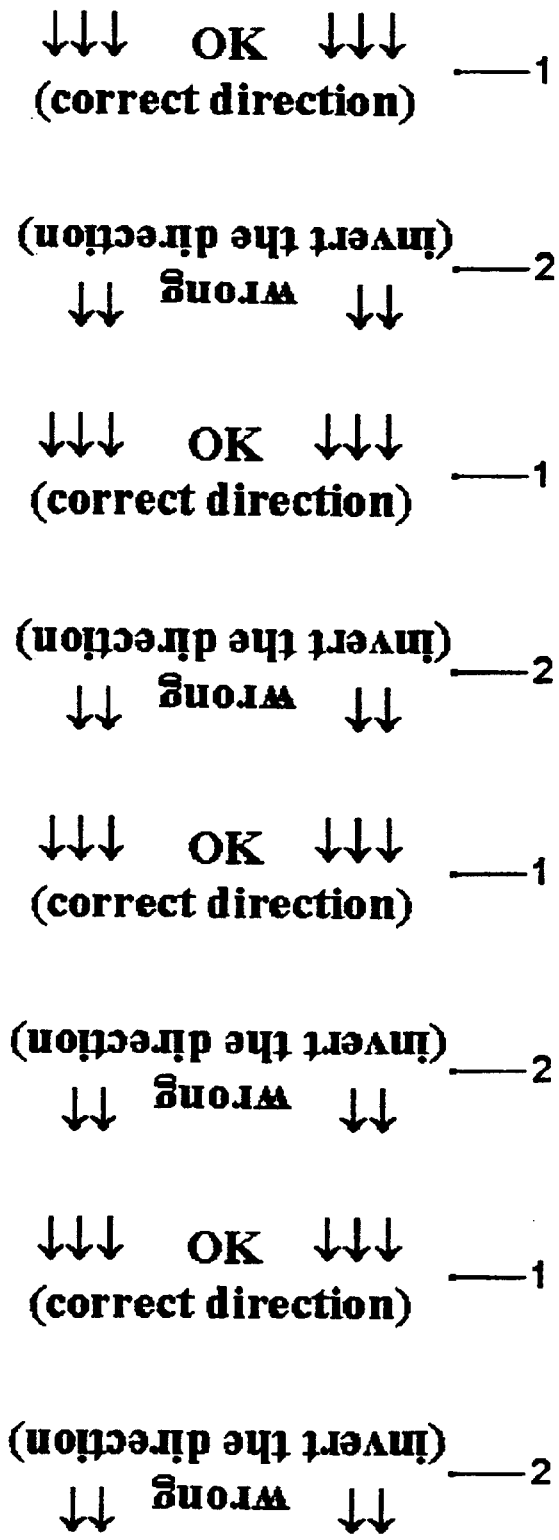

FIG. 2 illustrates the indicator that should be placed on the roll. The words/phrases presented in FIG. 2, in English, as well as the arrows are demonstrative characters and may be written in other languages and different colours. The indicator shown in FIG. 2 presents a column formed by two successive alternate groups of words/phrases and arrows in horizontal lines informing basically if the direction is correct (1) or incorrect (2). They are upside down in relation to each other, so that if the figure is inverted, the words/phrases informing the correct direction (1) will be upside down, while the words/phrases informing the incorrect direction (2) will start to be easily read.

Figure 3A:
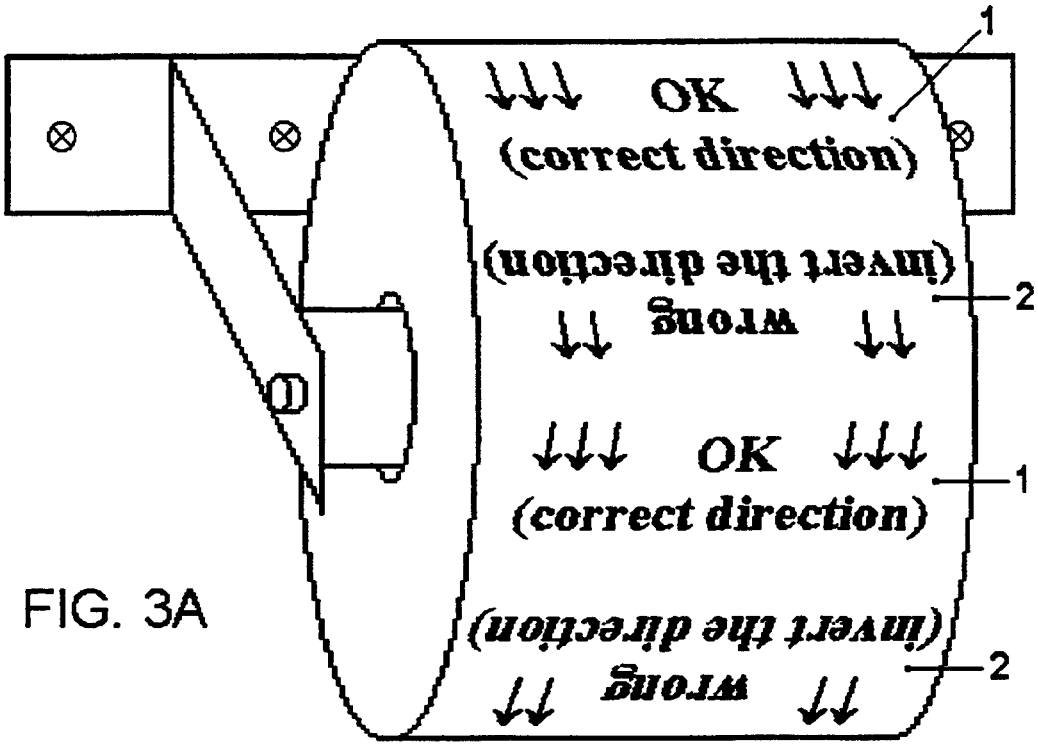
Figure 3B:
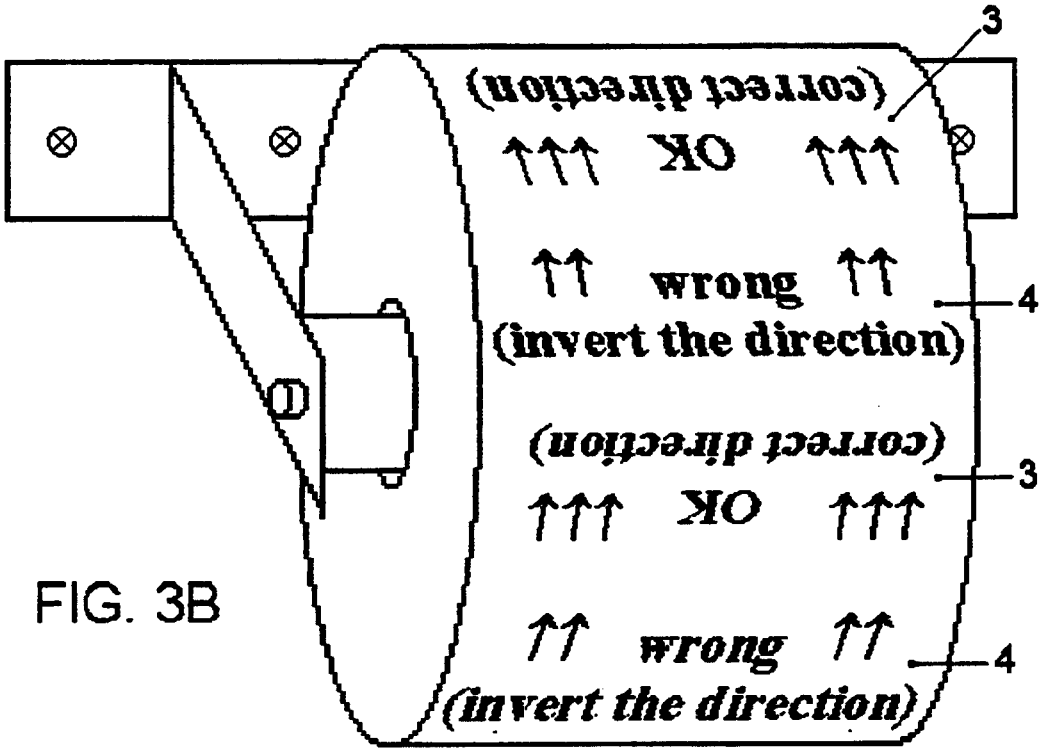

The proposed indicator can be printed in the involucre of the roll (where many times there are specifications of the product), or affixed in the roll. After its disposition on the roll the invention can be clearly demonstrated, as it is shown in FIGS. 3A and 3B. It can be observed that in FIG. 3A the roll is displaced in the way that the manufacturer will suggest, that can be designed as the proper way, with the words/phrases and arrows informing the more correct direction (1) with the head upward, while those of the incorrect direction (2) are upside down. On the other hand, in FIG. 3B the roll is clearly displaced in the incorrect direction, with the words/phrases and arrows informing the more correct direction upside down (3), while those of the incorrect direction with the head upward (4). The correct displacement direction and the incorrect displacement direction can be verified easily by the installer, because there is a natural tendency of people to read what it is written in the usual direction of writing and reading, with the letters with the head upward and from the left to the right (1 and 4); and a natural difficulty to read what is written upside down and from the right to the left (2 and 3).

Moreover, it can be observed that the difficulty to understand what is written upside down tends to become still larger if the letters are written in lower cases, because many lower case letters upside down are equal or resemble other lower case letters with the head upward, confusing more the understanding of the words/phrases that are upside down (2 and 3), which is helpful for the mechanism of the invention. The sequence of words/phrases and arrows with the head upward (1 and 3) reinforces the message for the installer to observe if the roll is displaced in the correct or incorrect direction. Another point that is worthwhile to mention it is the additional function that the arrows tend to carry out, helping in the indication of the direction. Finally, it can be mentioned that a great advantage of the invention is to obtain in a simple way a group of factors that amplify and give an appropriated feedback to verify and to correct the proper displacement of the roll in the rotating device.

What is claimed is:

1. An indicator of the proper direction of exit of paper and of other materials in rolls, characterised by presenting a column formed by two successive alternated groups of words/phrases and arrows in horizontal lines, informing basically if the direction is correct or incorrect, written upside down in relation to each other; this group of words/phrases and arrows can be printed in the covering of the roll, or can be affixed in the roll; and the person who will install the roll can observe and verify if the roll is being displaced in the correct or incorrect direction.

* * * * *